US005314119A

United States Patent [19]

Watt

[11] Patent Number: 5,314,119

[45] Date of Patent: May 24, 1994

[54] METHOD AND APPARATUS FOR APPLYING THIN COATINGS OF FLUID DROPLETS

[75] Inventor: Kenneth R. Watt, Huron, Ohio

[73] Assignee: Latanick Equipment, Inc., Huron, Ohio

[21] Appl. No.: 130,841

[22] Filed: Oct. 4, 1993

Related U.S. Application Data

[63] Continuation-in-part of Ser. No. 869,757, Apr. 20, 1992, abandoned.

[51] Int. Cl.[5] ..... B05B 1/28; B05B 3/02

[52] U.S. Cl. ..... 239/220; 239/121; 239/288

[58] Field of Search ..... 239/219, 220, 221, 121, 239/288

[56] References Cited

U.S. PATENT DOCUMENTS

| | | | |
|---|---|---|---|
| 694.106 | 2/1902 | Metcalf et al. | 239/220 |
| 1,588.062 | 6/1926 | Spivey | 239/220 |
| 1,753,251 | 4/1930 | Sjostrom | 239/220 |
| 1,801,830 | 4/1931 | Winstanley et al. | 239/220 |
| 1,882,439 | 10/1932 | Murphy | 239/220 |
| 2,199.093 | 4/1940 | Wolfenden | 239/220 |
| 2,291,046 | 7/1942 | Lange | 239/220 |
| 2,946.516 | 7/1960 | Wagner | 239/219 |
| 3,735,929 | 5/1973 | Pleines | 134/64 |
| 3,873.025 | 3/1975 | Qvarnstrom | 239/220 |
| 5,097,791 | 3/1992 | Barrois et al. | 239/220 |

FOREIGN PATENT DOCUMENTS

| | | | |
|---|---|---|---|
| 627480 | 9/1961 | Canada | 239/220 |
| 1128096 | 7/1982 | Canada | 239/220 |
| 2925026 | 8/1981 | Fed. Rep. of Germany . | |
| 514478 | 11/1920 | France | 239/220 |
| 986250 | 3/1951 | France | 239/221 |
| 1339916 | 12/1973 | United Kingdom | 239/220 |

*Primary Examiner*—Andres Kashnikow
*Assistant Examiner*—Christopher G. Trainor
*Attorney, Agent, or Firm*—Francis J. Bouda

[57] ABSTRACT

A method and apparatus for applying thin coatings of fluid droplets to an adjacent surface includes a pickup roll rotating in a supply of fluid and a rapidly rotating brush roll having a surface formed by bristles thereon. The two rolls rotate with an interference between them whereupon the bristles are bent as the tips thereof pick up a droplet of fluid. After passing out of inteference, the bristles snap forwardly and project the droplets in a mist form against the adjacent surface. The spray pattern is maintained with uniformity in both a cross-machine direction and a machine- direction by a windage control device which may incorporate, selectively, a spray-doctor, a knife doctor blade, windage control mechanism including end-cavity windage dams, spacers, brush windage knife, mist eliminator, brush end rings, seals and spacers.

5 Claims, 5 Drawing Sheets

METHOD AND APPARATUS FOR APPLYING THIN COATINGS OF FLUID DROPLETS

This application is a continuation-in-part application of Ser. No. 07/869,757 field Apr. 20, 1992, now abandoned.

BACKGROUND OF THE INVENTION

It is well-known in the art to apply thin coatings of fluid material by sprayed techniques utilizing pneumatic sprays, roller-coating, brush-coating, and the like. Such devices can apply thin coatings of fluids, either in the liquid form, such as adhesives, paint or the like, or in the solid or semi-solid state, such as pellets, beads and the like.

The present invention relates to that kind of applicator which utilizes a plurality of bristles in a brush-like configuration which is agitated so as to flick small droplets of the material-to-be-coated from a supply source to the object to be coated.

Such devices may be in a bristle-brush form in roll or cylindrical configuration, or bristle-brush form in an upstanding array which, when agitated, flicks the pellets, droplets, beads or mist from the edge of the bristles onto the target or subject to be coated.

Devices of this nature have been disclosed in U.S. Pat. No. 3,735,929 dated May 29, 1973 and titled "DEVICE FOR APPLYING A SELECTED MOISTURE CONTENT TO A WEB MADE OF A FIBROUS MATERIAL" as well as in German patent DE 2,925,026 published Jun. 21, 1979 and titled "FIBROUS WEB DAMPENER USES WATER-STEAM MIXTURE". These prior art patents fail, however, to teach how the extremely fine and uniform coating of droplets may be applied to the target material in a high-speed, efficient and economical manner.

The following comments with regard to other prior art patents are relevant:

U.S. Pat. No. 5,097,791 discloses only a bristle brush rotating in a container of fluid and the centrifugal force is utilized to throw the fluid off the tips of the bristles. It discloses no windage control mechanism.

Canadian Patent 627480 is used to spray plaster on the walls, and likewise uses only the centrifugal force to throw the material away from the roll. There is no windage control mechanism.

German Patent 24686 discloses a bristle brush rotating against a counter roller which, itself, rotates in a pan of fluid, but which does not include any windage control mechanism.

Similarly, French Patent 986250 shows counter-rotating bristle brush and fluid applicator roll, but with no windage control mechanism.

U.S. Pat. No. 629,513 discloses a spraying device for paints, but has no pickup roller_and merely flicks the paint from the tips of the bristles as the bristle roll is rotated by hand.

U.S. Pat. No. 694,106 utilizes rotating discs in a fluid pan with a splash plate. It has a cover but no windage control mechanism.

U.S. Pat. No. 1,588,062 shows a pickup roll, a mating roll, as well as temperature control, but has no reference to brush windage control, or any other means to control windage.

U.S. Pat. No. 1,753,251 shows a rotating brush dipped into a pan which sprays in a random pattern with a portion of the spray being discharged through a nozzle.

It claims to be a novel atomizer, but it shows no windage control mechanism.

U.S. Pat. No. 1,801,830 discloses a brush rotating in a trough to spray fluid as it passes an object, but does not show any windage control mechanism.

French Patent 514,478 illustrates a pickup roll rotating in the bath of oil, from which a bristle brush picks up the fluid and flicks the oil against a passing object as the bristles are interrupted by a stationary blade. It shows no windage control mechanism.

U.S. Pat. No. 2,946,516 uses rotating discs for spraying fluid. A second rotor with discs acts against the first roller but does not have any bristles, and indeed does not have any windage control mechanism.

U.S. Pat. No. 1,882,439 shows no cover over the rotating bristle brush, and no windage control mechanism whatever.

U.S. Pat. No. 2,199,093 shows a device which applies dye material to a fabric in spotted pattern. It has a flexible paddle wheel which strikes against a stationary member. It has no pickup roll, nor does it have any windage control mechanism.

Canadian Patent 360,069 discloses a pan with fluid and a pickup roll rotating against a slowly turning brush with heavy bristles. In this disclosure, the bristles flick the liquid as a result of the roughness of the rotating pickup roll, but shows no windage control mechanism.

U.S. Pat. No. 3,873,025 is entirely different, inasmuch as there is no brush roll whatever. It discloses a spreader roll which transfers the fluid to another roll, and it is only the centrifugal force between the two rolls which causes the fluid to be discharged. There is no windage control whatever.

U.S. Pat. No. 2,291,046 discloses a mechanism for supplying fuel oil to a furnace. Air is forced through and around the brush and into the fire through a nozzle with the fuel droplets well dispersed. However, there is no windage control device disclosed.

British Patent 1,339,916 shows a mechanism quite similar to the device of the present invention, but does not discuss, disclose, or make any claims about controlling air currents for uniformity and mist-control, and has no windage control device.

OBJECTS OF THE INVENTION

One object of the present invention is to provide a rotary bristle brush which discharges a spray-pattern of the coating material onto a moving target with extreme accuracy and uniformity.

A further object of the present invention is to provide an improved bristle-spray mechanism which includes a windage control mechanism to prevent unwanted variations in the coating operation.

A third objective is to provide a uniform application of fluid in both the machine direction and cross-web direction for extended periods of time. Fluid volume changes can be made maintaining uniformity and predictability.

Still a further object of the present invention is to provide a new and improved, highly accurate, brush-roll fluid application device for applying a uniform fluid application to a web consistently for an extended production time.

SUMMARY OF THE INVENTION

In the present invention a supply of fluid is contained in a container or pan which is supported closely adjacent a moving web or sheet of thin material such as a non-woven web used for the covering of sanitary disposable absorbent products, such as baby diapers, sanitary napkins, and the like. It can also be used in the manufacture of carpets, clothing (such as fabric facing), knitted, netted, needled or woven fabrics, paper, metal foil etc.

A pick-up roll rotates within the pan and in a manner whereby a quantity of the fluid from the supply pan is picked up on the surface of the roller from which it is transferred to a brush roller which is disposed adjacent and in conjunction with the pick-up roll.

The brush roll consists of a rotating cylinder or core with a quantity of bristles extending radially outwardly therefrom and of such a length that the tips of the bristles impinge against the surface of the pickup roll, and a quantity of the fluid is picked up on the tips of the bristles.

The bristles are twisted or bent at the moment of pick-up and then, after passing the centerline between the pick-up roll and the brush roll, the bristles snap forwardly and flick the fluid from the tips of the bristles away from the brush-roll and against the moving non-woven web.

In order that the pattern of fluid on the web is uniform, a family of windage dams and seals are incorporated to control windage generated by the brush rotation. Roll-end baffles, cross-windage dams and brush-windage knife are disposed closely adjacent the in-coming nip-side of the two rolls, closely adjacent the tips of the bristles on the bristle brush, and the surface of the pick-up roll rotating in a pan of fluid.

Careful adjustment of the cross-windage dam, brush-windage knife, the brush roll, the pick-up roll, doctor blades and mist eliminators combine to provide a uniform and unique pattern of the fluid on the non-woven web.

It is preferred that the pickup roll be prepared with a uniformly roughened surface so that a film having uniform thickness may be picked up. Ground rubber rolls, sandblasted surface treatment, or an engraved, grooved pattern are typical of such roll-surface preparation.

The engagement of the bristles with the pickup roll is extremely small, being in the nature of only 0.010 to 0.018". Thus the flicking process of the fluid droplets is due to the centrifugal force on the droplet, in addition to the bristle flick velocity.

An exemplary speed of rotation of the bristle brush roll is between 600 RPM to 1200 RPM. This high brush roll speed with respect to the pickup roll speed contributes to uniform fluid transfer of the droplets, and to the discharge pattern of very small droplets of fluid traveling at a high rate of speed.

However, the high rotational speed of the brush, when spraying a fluid, creates windage. This windage is generated by the bristle tips, by the spray pattern and more significantly by the fluid droplet size and the velocity around the cover.

At the axial ends of the brush, the bristles also create an air circulation due to a centrifugal force where it acts like a centrifugal pump propeller. The wind generated does two things:

a) It affects the uniformity on the pickup roll, creating waves on the film layer being transferred into the nip;

b) Wind also comes through the nip itself, and this wind coming through the nip carries mist and contaminates the surrounding area. Since it also comes through non-uniformly, it results in a non-uniform application to the traveling web.

In prior art, the wind coming through at the ends has a directional component toward the center of the machine creating end patterns which are "lighter" than the more uniform application at the center.

Because the brush used is constructed with a slight spiral which makes fluid transfer higher at one end, the cross-wind dams control uniformity from one side to the other.

It is the brush windage knife and the windage control device of the present invention which solves the problems set forth above.

By proper positioning and adjustment of the brush windage knife in relation to the tip of the bristles and the nip between the bristle brush and the pickup roller, this undesirable windage is controlled or substantially eliminated, and a uniform pattern of droplets is discharged on to the receiving material.

It is further respectfully submitted that the operation and function of the invention as disclosed and claimed is not disclosed in any of the prior art.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized, and that the invention is not limited to the precise arrangements and organizations of the instrumentalities as herein shown and described.

In the drawings, wherein like reference characters indicate like parts:

Figure 1:
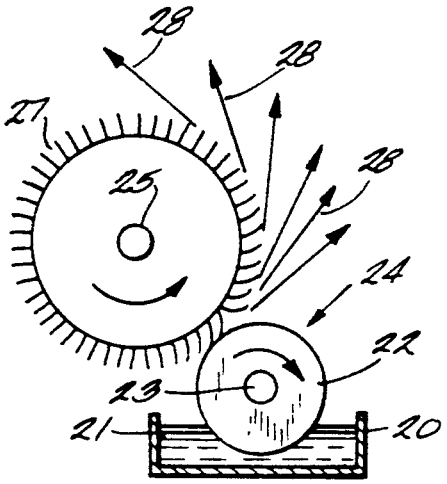
Fig. 1 PRIOR ART
FIG. 1 is a schematic sketch of a spray applicator of the PRIOR ART without any control mechanism.

Referring now to FIG. 1, there is shown a simple pan (20) in which a quantity of fluid (21) is disposed. A cylinder (22) rotates on a shaft (23) and picks up on the surface (24) of the roll (22) a quantity of the fluid (21). A second roller (25) rotating on shaft (26) has a plurality of bristles (27) attached to the outer surface thereof, and when the roll (25) rotates, the tips of the bristles (27) pick up fluid from the surface (24) of the roll (23) and after passing the centerline between the two rolls, the bristles (27) snap outwardly because there is an interference between the tips of the bristles and the surface of the roll (22) and the droplets of fluid are thrown off in the direction of the arrows (28). However, this is all done in an uncontrolled and random fashion.

Figure 2:
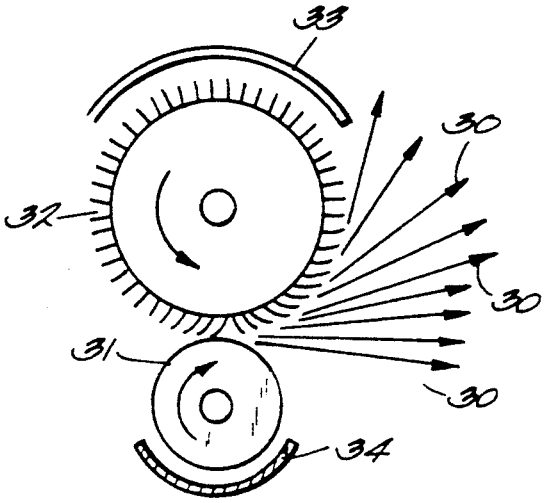
Fig. 2. PRIOR ART
FIG. 2 is a schematic sketch of PRIOR ART with improved spray applicator having some control features.

FIG. 2, which also shows the prior art, illustrates how a controlled discharge of the fluid droplets (30) can be cast away from the rolls (31) and (32) by utilizing the covers (33) and (34) appropriately disposed around the outside of the rolls (31) and (32). Nevertheless, in this configuration there is still an undesirable lack of control of the droplets in the discharge pattern.

Therefore, I have developed an improved applicator which launches fine droplets in a uniform pattern onto a moving web. The applicator is disposed in an enclosed assembly, not only for the careful handling of the materials which are chemical in nature, but also because the unique enclosure and consequent arrangement, the fluid is disposed on the web uniformly in the cross direction and also the machine direction of the moving web with negligible waste.

The fluid pattern is uniform because the component arrangement and their effect at controlling windage created by the rotating brushes. Windage generally destroys uniformity of the spray pattern, and by utilizing the cross-wind dams, brush-windage knife, and other windage control mechanisms of the present invention, the pattern is uniformly and economically disposed on the moving web.

Figure 3:
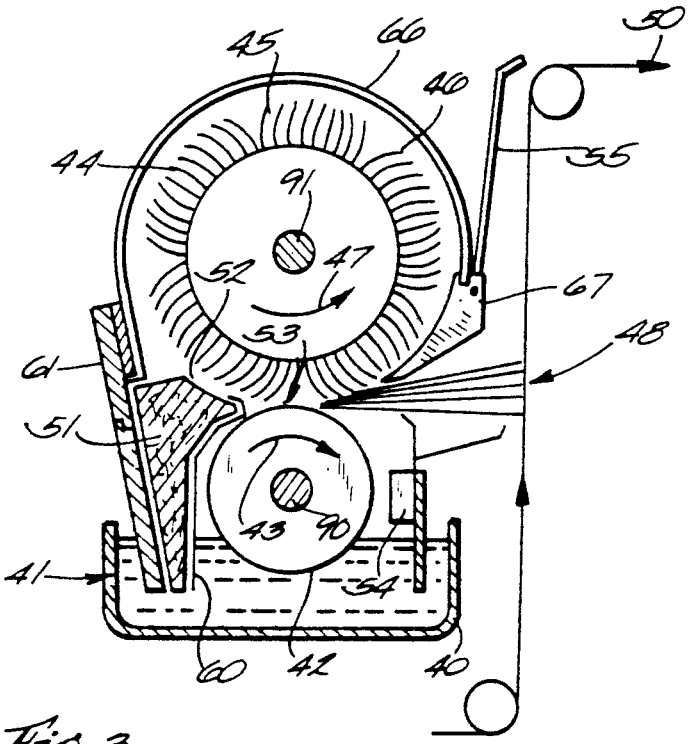
FIG. 3 is a cross-sectional view of the brush-spray fluid applicator of the present invention.

In this configuration as shown in FIG. 3, a pan (40) similar to that shown in FIGS. 1 and 2, carries a quantity of fluid (41) which is picked up on the surface of the rotating roll (42) which turns in the direction of the arrow (43).

Oppositely disposed from the pick-up roll (42) is the rotating brush roll (44), the bristles (45) of which, at their tips (46) contact the surface, in an interfering manner, of the roll (42) and pick up droplets of the fluid (41).

As the brush roll (44) rotates in the direction of the arrow (47), the spray pattern of droplets is discharged as at (48) against the web (49) which is moving in the direction of the arrow (50).

Cross-wind dams (51) and brush-windage knife (60) are disposed adjacent the entry nip (52) between the rolls (42) and (44), so as to control the flow of air which is drawn by the rotating brush into the nip and which, if not controlled, causes a disruption of the droplet pattern (48) discharging on the outlet side of the brush roll (44).

Controlling the windage created by the rotating brush also ensures the fluid in the pan is not disturbed, as well as not disturbing the fluid film which is being raised by the rotating pick-up roll.

Figure 4:
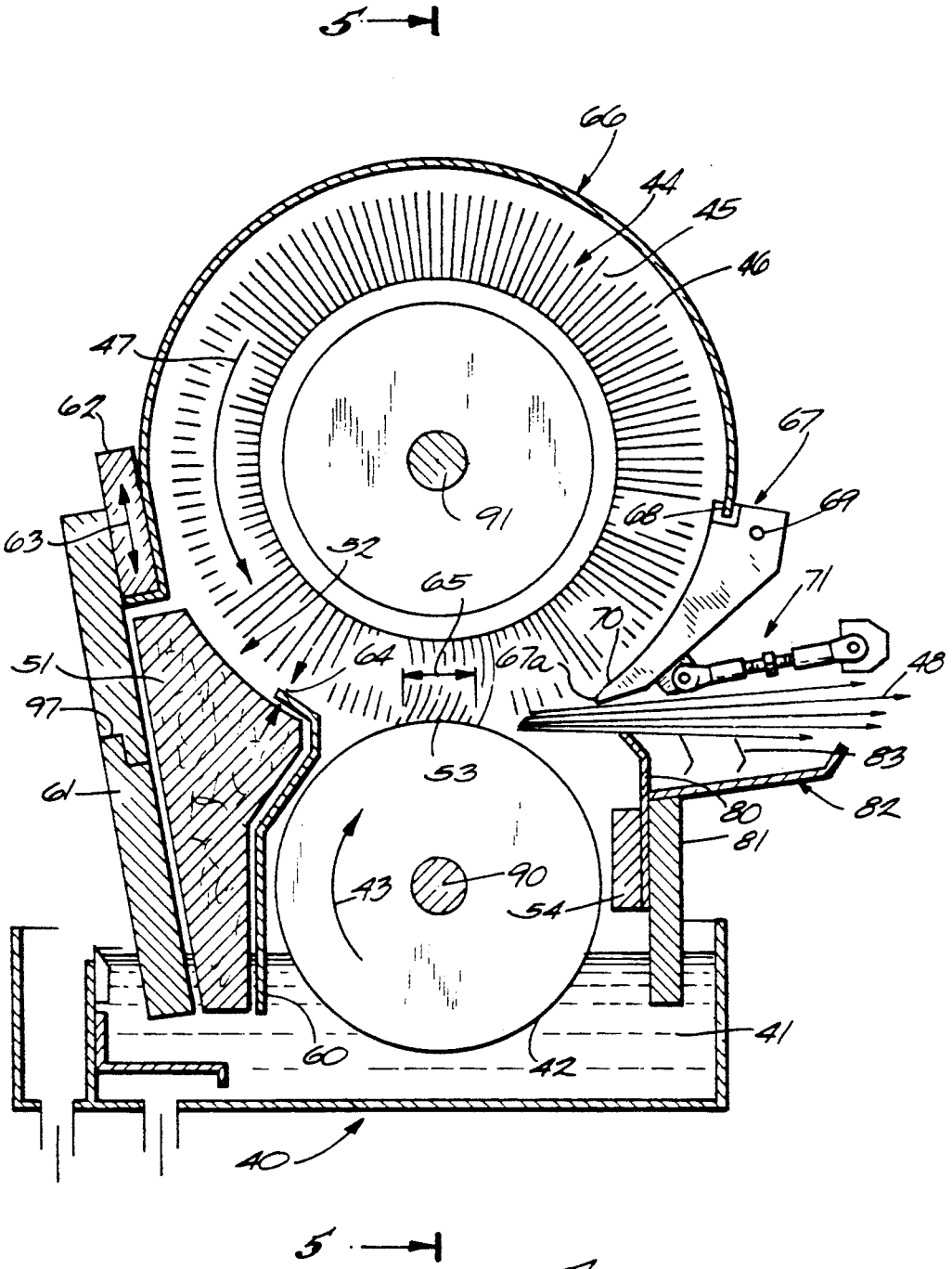
FIG. 4 is an enlarged, cross-sectional view similar to FIG. 3 showing in more detail the windage-control mechanism of the present invention.

The clearest reference in the drawings to the brush windage knife is shown in FIG. 4 where the knife (60) has an upper edge which defines a gap between the tip of the knife and the adjacent tips of the bristles rotating past it.

Although only a cross-section of the knife is shown, it is to be understood that this is a one-piece, continuous solid member extending longitudinally, parallel to the axis of the bristle roll, in a line across the entire face of the roll.

By moving the knife and its supporting members in the direction of the arrow 63, the gap 64 can be accurately controlled, and it is a control of this gap by the positioning of the brush windage knife which eliminates the unwanted and unnecessary air currents which affect the uniformity of the droplet application, and which cause misting and contamination of the deposited droplet.

The term "brush windage knife" is used by the inventor to identify the mechanism (60) which eliminates these uniformity-distributing air currents in the devices of the prior art.

Referring now to FIG. 4, there is shown more clearly the windage-control mechanism of the brush-windage knife (60), cross-wind dams (51), submerged supports (61) (81), a pull bar (62), and adjustable cover (66). The brush-windage knife is arranged and supported adjacent the rolls (42) and (44) so that the knife can be moved generally vertically, in the direction of the arrows (63), so as to adjust the clearance (64) between the brush-windage knife and the tips (46) of the bristles (45).

The distance between the center of the pick-up roll (42) and the center of the brush-roll (44) is less than the sum of the radius of the brush-roll from center to tip of bristle, plus the center of the pick-up to the surface of the pick-up roll. The interference between these two rolls is generally indicated by the arrows (65).

Around the circumference of the brush roll (44), an adjustable cover (66) is supported (as, for instance, by the pull-bar (62). At the distant end therefrom, a doctor-blade (67) is fastened at (68) and pivots at (69) so that the tip (70) of the doctor-blade may be moved toward and away from the tips of the bristle-brush by the adjusting links (71). The ends of the cover (66) are sealed against the end frames (72) with seal (73).

Beneath the spray pattern (48) as it discharges from the outgoing nip (53), a spray doctor (80) supported on a frame (81) holds a drip pan (82) which includes a mist eliminator (83).

Figure 7:
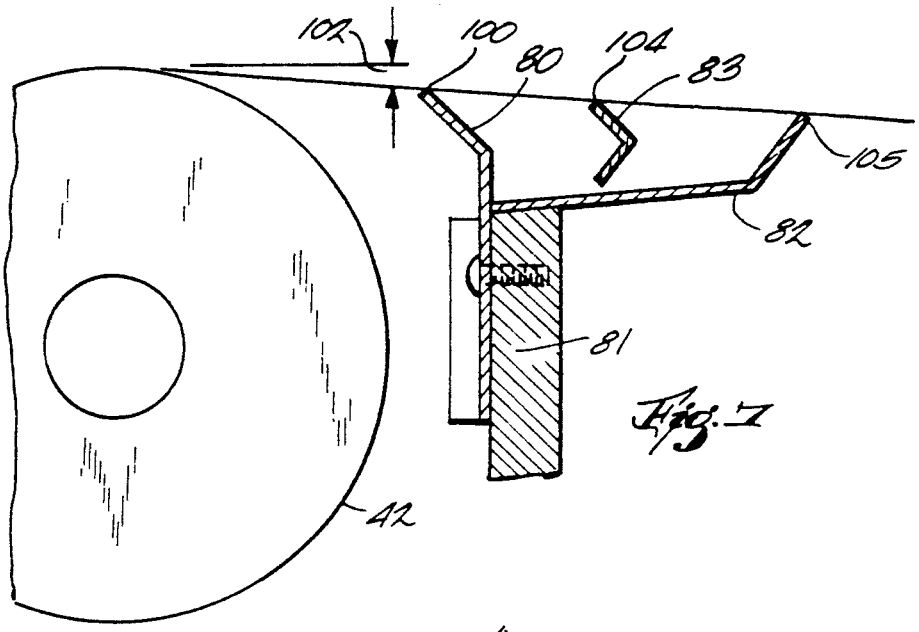
FIG. 7 is an enlarged portion of the lower spray doctor and mist-eliminator section of the present invention.
Figure 8:
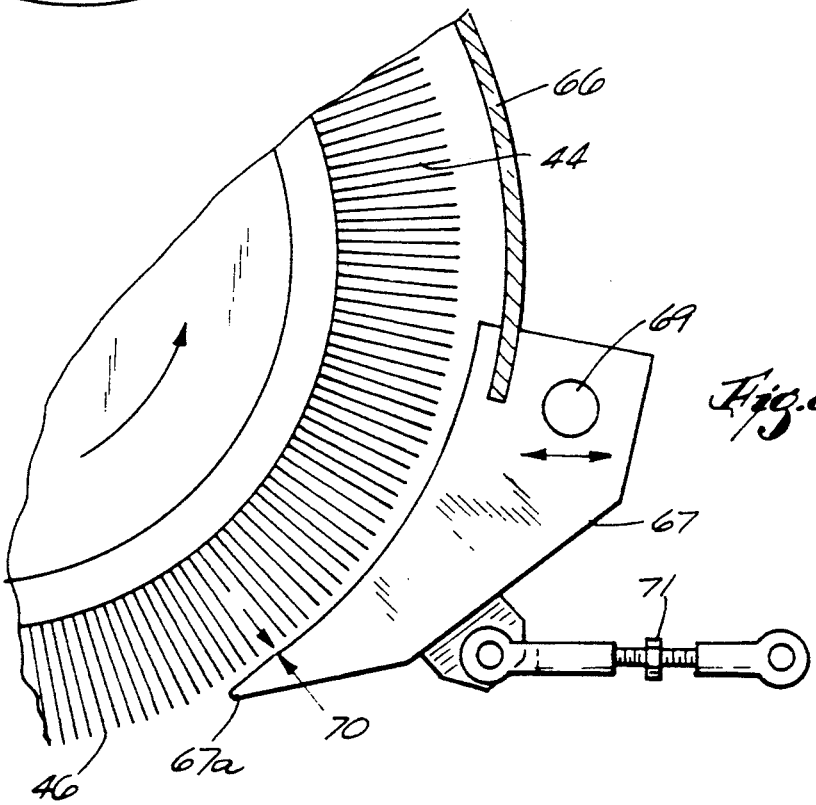
FIG. 8 is an enlarged view of the upper doctor blade showing the adjustable pivot support and tip adjusting mechanism of the present invention.
Figure 9:
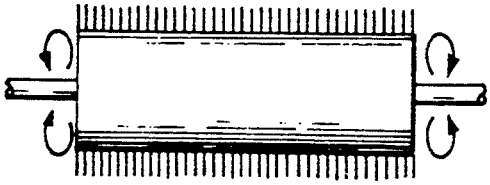
FIG. 9 illustrates how the bristles at the end of a brush create a wind circulation.

The doctor-blade (67) and its mechanism is shown more clearly in FIG. 8 and the mist-eliminator (83) is shown more clearly in FIG. 7.

Figure 5:
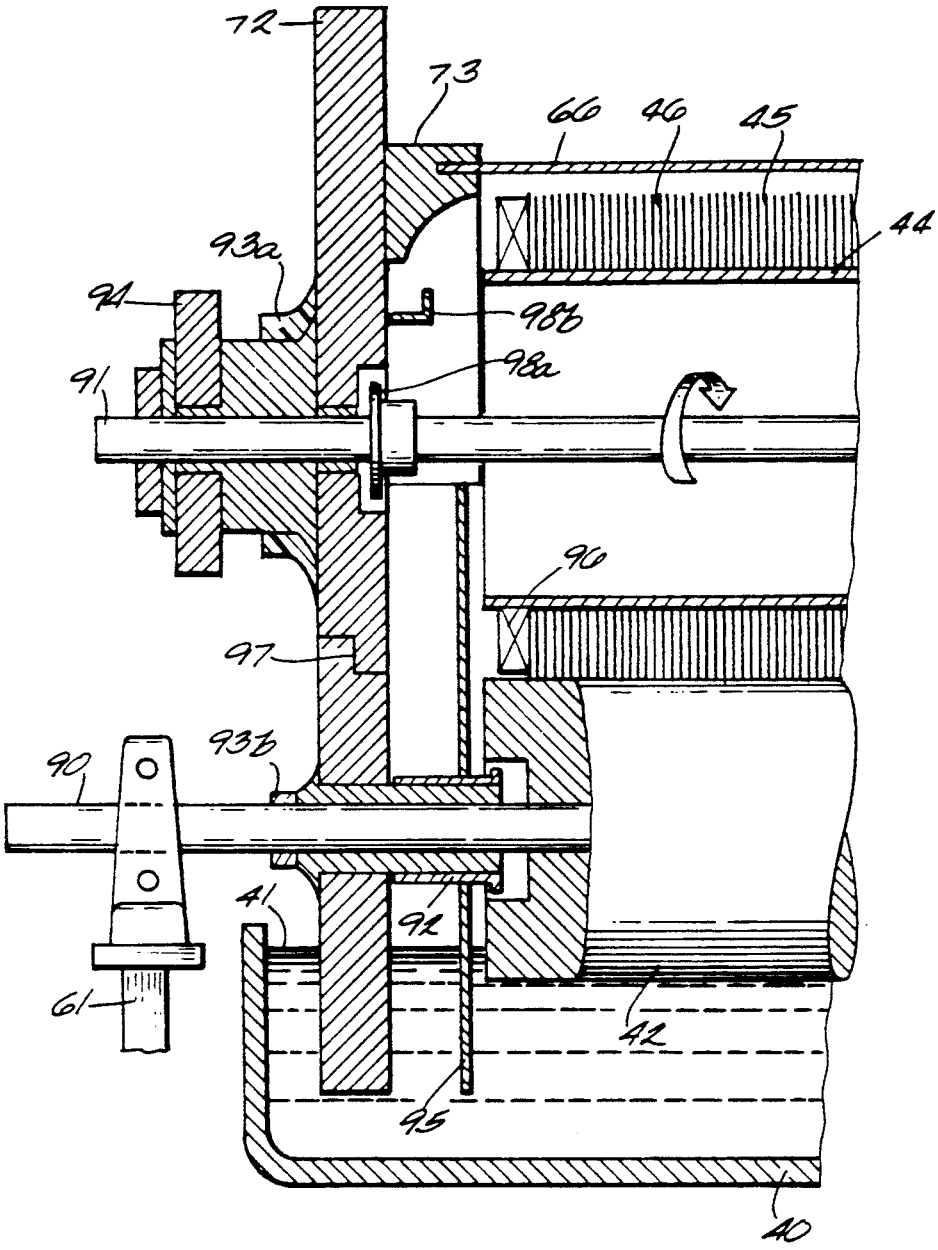
FIG. 5 is a vertical cross-sectional view taken generally along 5—5 of FIG. 4, showing shaft seals, shaft slingers, and brush and pick-up roll windage baffles.

In FIG. 5, the arrangement of the pick-up roll (42) is shown carried on a shaft (90), and the brush-roll (44) is shown to be carried on a shaft (91). An appropriate shaft-protector (92) for shaft (90), and fluid slinger (98*a*) and gutter (98*b*) for shaft (91), and a sealing device (93*a*) (93*b*) for shaft (91) (90) provide incoming wind seals. Shaft (91) is carried in a pivot- arm (94) so that the tips of the bristles (46) can be moved toward and away from the surface of the pick-up roll (42).

Figure 6:
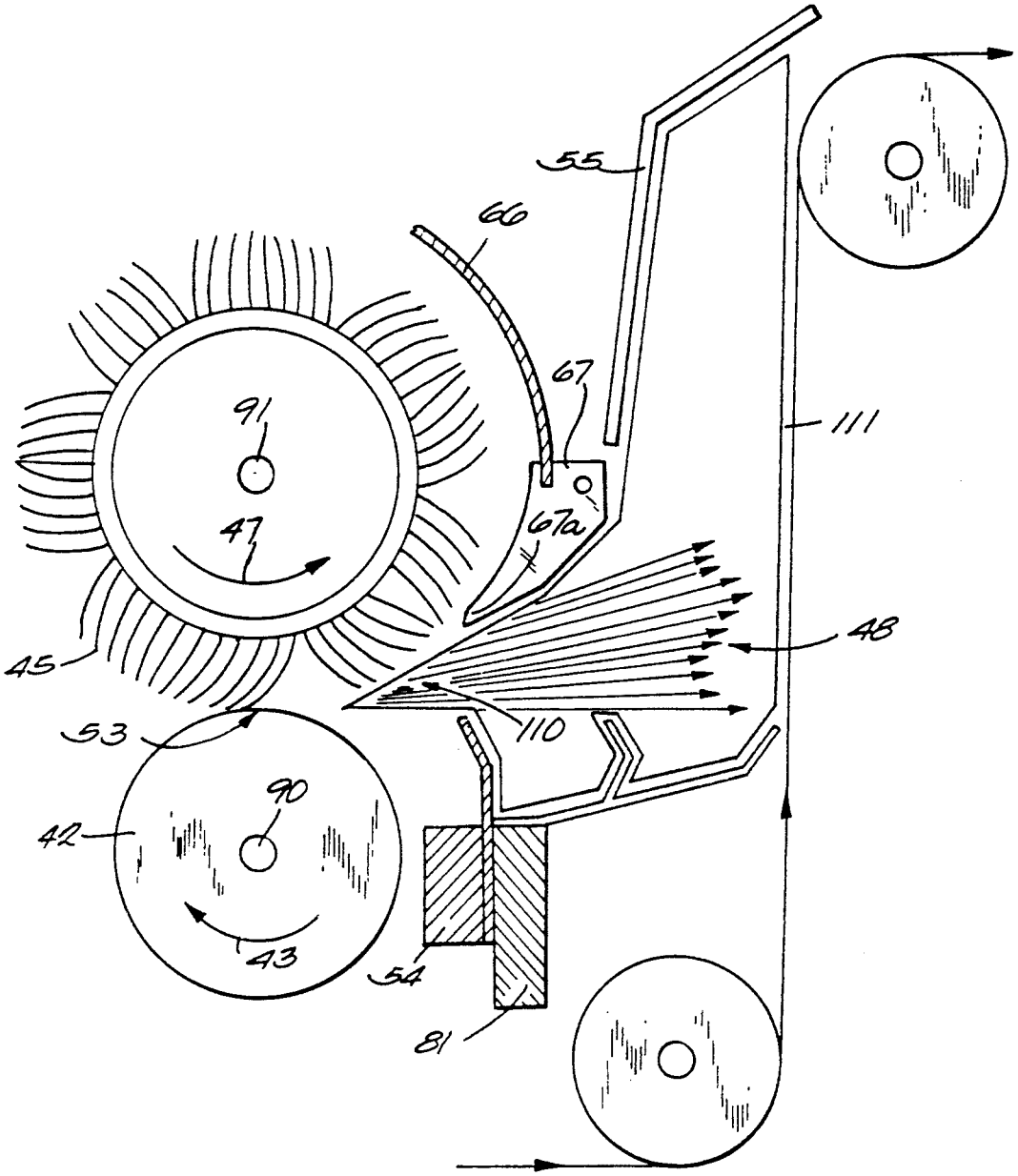
FIG. 6 is a schematic illustration of the brush-roll acting in interfering communication with the pick-up roll.

Referring now to FIG. 6, there is shown how the brush-roll bristles can contact the pick-up roll, so as to be bent either forward or backwardly. I have found that bristles which are bent forwardly do not wipe as well and can cause variation or change in the spray pattern, and are called spray-patterns fluctuations or pulsing. Although a small amount of harmonic pulsations may be corrected by changing the brush speed, they, nevertheless, are undesirable because they interfere with the uniform and economic distribution of the fluid pattern on the moving web. The doctor blade tip (67*a*) is positioned just after the first harmonic to separate the main droplet pattern from random patterns caused by 2nd and 3rd bristle harmonics. Cutting off the minor harmonics reduces misting, fluid losses, and contribute to general cleanliness in the area.

Referring once more to FIG. 6, there is shown the spray-pattern-width side shields (111). Two shields, one being on each side of the spray pattern, isolate the spray pattern (48) from cross currents. The two shields (111), shield (55) web (50) and drip pan (82) completely enclose the spray pattern (48). It is to be understood also that the shields enclosing the spray pattern and containing mist which may potentially contaminate surrounding machinery, are designed to drip back into the drip pan (82) and back into the fluid pan (40). The result is a spraying process with minimal over-spray and mist contamination and maximum utilization of the fluid.

The width of the spray pattern (48) is generally controlled by the lengths of the brush roll (44) and pick-up rolls (42). Narrower spray patterns can be obtained by inserting an adjustable spray pattern deflector (110) between the doctor blade tip (67*a*) and spray doctor (80) which directs the spray pattern back into the fluid pan (40). This close fitting deflector also is important in sealing off air entry into the brush roll (44) end cavities. (See the spray pattern deflector (110) in FIG. 6.

The remaining mist on top of the spray pattern is funneled into the traveling web by baffle (55)

In FIG. 7 I have shown how the lower spray-doctor (80) and the mist-eliminator (83) are disposed in relation to the pick-up roll (42). The upper edge (100) of the lower spray-doctor (80) is slightly below a horizontal line extending at right angles to the line drawn between the axis of the brush roll and the axis of the pick-up roll (42). This dimension is indicated at (102).

The mist-eliminator (83) has its upper edge (104) still more slightly lower than the tip of the spray-doctor (100), and furthermore, the tip (105) of the drip-pan (82) is still further in a lower position. However, as is shown at (107), it is desirable that the tips (100), (104), and (105) be generally in a straight line, and this can be arranged by holding a straight edge between the tip (100) and the tip (105) and adjusting the tip (104) to be in contact with the straight edge.

FIG. 8 illustrates how the doctor-blade (67) adjusting and pivoting at (69) can be adjusted by the linkage (71) so that the tip (70) of the doctor-blade can be carefully spaced from the tips (46) of the brush-roll (44). Desirably, a feeler-gauge or brass shim stock of approximately 0.015" thickness is used to correctly space the tip (70) from the tips of the bristles (46).

In FIGS. 4 and 5 is shown how the support members enter the fluid pan (40), restricting air from entering the cavity on the bottom side.

With the arrangement as described above, air is restricted from entering the enclosure. Wind created by the brush under the cover is restricted from entering the roll nip (53) and from effecting the fluid being carried up by the pick-up roll. Windage under the cover is reduced by adjusting the cover close to the brush by pulling the cover down with bar (62). Air is restricted from entering the nip (53) and the roll ends by end baffle (95) and brush roll end baffles (96). No air enters the incoming nip (52) from around the surface of the pick-up roll (42) because the lower end (110) of the cross-wind-dams (51) and brush-windage knife (60) is disposed beneath the surface of the fluid (41) in the pan (40).

At the axial ends of the brush the bristles also create an air circulation due to the centrifugal force where it acts like a centrifugal pump propeller.

Several features of the apparatus are notable for the improvements which they have made to the operation of the machine.

The spacer (54) shown in FIGS. 3, 4 and 6, affords more precise restriction of air from entering the cavity. The painting of the doctor blade reduces the collection of fluid droplets thereon. The urethane seal (93) and large brush end ring (96), coupled with the end cavity windage dams (95) (shown in FIG. 5) afford more precise control and placement of the mist- spray. In addition, the frame-split (97) improve the flexibility of adjustment and control of the cross windage dams (51) and brush windage knife (60).

In the operation, it is to be noted that pick-up roll speed varies fluid spray volume, brush roll lifting stops fluid spray, and brush speed controls droplet size and velocity.

Fluid application rates can be varied over a broad range because the rotation speed of the pickup roll can vary between one revolution per minute and 400 revolutions per minute.

Thus I have described a fluid applicator which is a compact, precision-built production machine, ideal for treating fabrics, such as non-wovens and paper webs in wide widths, with fluid droplet patterns uniformly applied to the web. Although the basic principle of fluid-metering rolls submerged in fluid, engaging with a brush-roll that flicks droplets onto a moving web is not new, the arrangement of the cross-wind dams, brush-windage knife and windage-control mechanisms, coupled with the mist-eliminator (83)(55) and the drip pans and spray doctor, all combine to provide a unique, carefully controlled brush-spray fluid applicator.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. In an apparatus for applying thin coatings of fluid droplets to an adjacent surface, said apparatus including a fluid container, a supply of fluid in said container, a pickup-roll rotating in said container whereby a film of said fluid is picked up on the surface of said pickup-roll, a rotatable brush-roll having bristles said brush-roll and said pickup-roll defining an entry nip, wherein the tips of the bristles pick up droplets of said fluid from the surface of said pickup-roll and project a spray pattern away from said rolls, said apparatus further comprising a windage control device including a cross windage dam extending adjacent to the entry nip, a brush windage knife supported adjacent to the entry nip to define a clearance between the windage knife and the tips of said bristles of said brush-roll, and end cavity windage dams disposed perpendicularly to said cross windage dam adjacent the ends of said rolls, 2. The apparatus of claim 1 including a mist eliminator supported adjacent to an outgoing nip of said rolls.

3. The apparatus of claim 1 including a spray doctor supported adjacent to an outgoing nip of said rolls beneath the spray pattern and a doctor blade pivotally supported adjacent to the tips of the bristles on the brush-roll on an outlet side of said rolls.

4. The apparatus of claim 1 including brush end rings secured about the ends of the brush roll.

5. The apparatus of claim 2 wherein said mist eliminator includes a spacer secured between the mist eliminator and said pickup-roll.

* * * * *